United States Patent [19]

Forbes, Jr.

[11] Patent Number: 4,531,668

[45] Date of Patent: Jul. 30, 1985

[54] OVENABLE CARTON WITH REMOVABLE LID

[75] Inventor: Hampton E. Forbes, Jr., Wilmington, Del.

[73] Assignee: Westvaco Corporation, New York, N.Y.

[21] Appl. No.: 617,744

[22] Filed: Jun. 6, 1984

[51] Int. Cl.[3] ..... B65D 5/54; B65D 5/64

[52] U.S. Cl. ..... 229/43; 206/612

[58] Field of Search ..... 206/612, 628; 229/43

[56] References Cited

U.S. PATENT DOCUMENTS

| | | | |
|---|---|---|---|
| 2,138,874 | 12/1938 | Myers | 206/628 |
| 2,953,293 | 9/1960 | Anderson | 206/612 |
| 3,043,472 | 7/1962 | Nemoede | 206/628 |
| 3,158,491 | 11/1964 | Farrell et al. | 206/62 |
| 3,244,356 | 4/1966 | Wolowicz et al. | 206/628 |
| 3,572,576 | 3/1971 | Foster | 229/31 |
| 3,982,685 | 9/1976 | Shimoda | 206/628 |
| 4,043,503 | 8/1977 | Meyers et al. | 206/613 |
| 4,158,412 | 6/1979 | Wysocki | 206/612 |
| 4,183,458 | 1/1980 | Meyers | 229/44 R |
| 4,194,680 | 3/1980 | Scott et al. | 206/612 |
| 4,285,461 | 8/1981 | Meyers | 206/612 |
| 4,351,473 | 9/1982 | Manizza | 206/612 |
| 4,386,706 | 6/1983 | Korte | 206/628 |
| 4,449,633 | 5/1984 | Johnson et al. | 206/612 |

*Primary Examiner*—Stephen P. Garbe

[57] ABSTRACT

A tray type, ovenable carton having a cover with a removable lid portion is provided with increased strength and rigidity by locating the cut lines in the cover so as to leave substantial portions thereof attached to the tray when the lid is removed. The preferred structure comprises separate components including a leakproof tray with side walls having an integral, outwardly extending flange around the upper edges of the side walls, and a separate one piece cover. The cover is sized with overall dimensions corresponding to the tray and flange areas and is adhered to the tray flanges at its peripheral edges. The removable lid portion of the cover is formed by a pair of spaced apart, parallel cut lines of partial depth on opposite surfaces of the cover. The cut lines are both located inwardly of the flange area of the tray with selected portions arranged to be substantially parallel to the side walls of the tray and other portions arranged to extend diagonally or arcuately within the cover member between adjacent side walls of the tray. The removal of the lid portion from the cover member leaves intact substantial parts of the cover member attached to the flange area of the tray so as to reinforce and strengthen the side walls of the tray.

3 Claims, 11 Drawing Figures

55
61
50
57
56
58
59
50
53
54
60
63
10
52
66
64
51
65
10

55
58
56
59
53
54
52
11
63
66
64
51
65
11

52
53
54
62
51

52
63
62
51

OVENABLE CARTON WITH REMOVABLE LID

BACKGROUND OF INVENTION

The present invention relates to cartons, and more particularly to cartons of the tray and lid type which are fabricated from paperboard for packaging food. The tray type cartons disclosed herein are especially useful as ovenware for both conventional and microwave ovens.

Tray type cartons are old in the art. In the past such cartons have been fabricated from both paperboard and metal. Such cartons must be leakproof so that they are capable of handling liquid and semi-liquid foods. However, with the advent of microwave ovens, paperboard cartons have been growing in popularity because of their broader utility. Paperboard, when properly treated with heat resistant coatings, is equally useful as a carton material for both conventional and microwave ovens, whereas metal cannot be used in a microwave oven.

One such tray structure is disclosed in U.S. Pat. No. 4,351,473 granted to Guelfo A. Manizza. The tray and cover structure disclosed in Manizza is designed with a removable lid portion which leaves a portion of the cover attached to the flange area of the tray when the lid is removed. However, the structure of Manizza still suffers from a lack of structural rigidity after the lid is removed, especially when liquid or semi-liquid products are packaged. In Manizza, the portion of the cover which remains attached to the flange is no greater than, and actually slightly less than the width of the flange area when the lid is removed. Thus it is difficult and sometimes impossible to pick up the tray of Manizza by grasping one corner after the lid has been removed.

In accordance with the present invention, a tray structure substantially as shown in Manizza has been made substantially stronger simply by moving the cut lines in the cover member which form the lid cut out inwardly away from the tray flange area. In doing so, the opening in the cover provided by the removable lid is reduced, but the remaining cover material left intact around the periphery of the flange increases the strength of the tray by a surprizing amount as compared with the strength of a non-reinforced structure, or a structure which is partially reinforced as taught by Manizza.

SUMMARY OF INVENTION

In accordance with the present invention, a tray and cover combination is disclosed for use in ovenware packaging. The tray structure is of generally rectangular configuration and is formed from a single blank of paperboard with a heat resistant coating. The tray includes a plurality of side walls which are preferably tapered outwardly so the tray has good stacking ability, and with corner connecting web panels which are overlapped and adhered to one another to form leakproof corners. The side walls and corner panels also include integral flange portions along their top edges which extend outwardly from the side walls of the tray in a generally horizontal plane when the trays are formed.

The cover structure is also prepared from a single blank of heat resistant paperboard and is cut and sized so as to fit over the tray with its overall dimensions corresponding to the overall dimensions of the tray and flange areas. Thus, when a cover member is fitted to a tray, the outer edges of the cover member become substantially aligned with the outer edges of the tray flange area around all sides of the tray. The cover member is also applied with a pair of spaced apart, parallel partial cut lines located respectively on the inner and outer surfaces of the cover, which together form a tear area for removing the lid portion of the cover and opening the tray to expose its contents. The partial cut line in the outer surface of said cover member is preferably arranged to be located nearest to the tray flange area and spaced from the inner edge of the flange by a distance equal to or greater than about one-half the width of the flange, while the partial cut line in the inner surface of said cover member is preferably spaced from the inner edge of the flange by a distance equal to or greater than the entire width of the flange. These cut lines together form a delaminatable tear area in the cover member which defines the removable lid portion of the cover. In addition, one corner of the cover member is provided with an opening means which provides access to a lift tab for removing the lid portion. In each case, the opening means is formed by a first partial cut line in the outer surface of the cover member which extends from the corner of the cover to a diagonally oriented portion of the partial cut line in the outer surface of the cover. At each end of the diagonally oriented portion of the outer partial cut line, the ends thereof are reconnected to the remaining portions of the outer partial cut line by a pair of abbreviated sections which are arranged to be generally parallel to the diagonal portion of the outer partial cut line and parallel to the remaining portions of the outer partial cut line at each side of the cover member. These cut lines form an integral lift tab element for the removable lid portion.

After the tray is filled with product, the cover member is adhered to the flange area of the tray around its peripheral edges. In this condition, the tray and its contents can be heated as desired. When it is desired to open the carton, the easy opening means at one corner is activated by pushing downwardly on the partial cut line from the apex of the corner of the cover to the diagonally oriented portion of the outer partial cut line. This action tends to break the seal along the outer cut lines at the corner and frees a lift tab for completion of the opening step. When the lid is removed from the combined tray and cover member, the paperboard delaminates between the partial cut lines in the inner and outer surfaces of the cover member. The lower portion of the delamination area remains attached to the portions of the cover which stay adhered to the tray flange area and the upper portion of the delamination area remains attached to the removable lid portion. Because of the orientation of the partial inner and outer cut lines within the cover member, a substantial portion of the cover member remains attached to the flange area of the tray when the lid portion is removed to provide a dramatic and unexpected increase in the strength of the opened carton.

DETAILED DESCRIPTION

Figure 1:
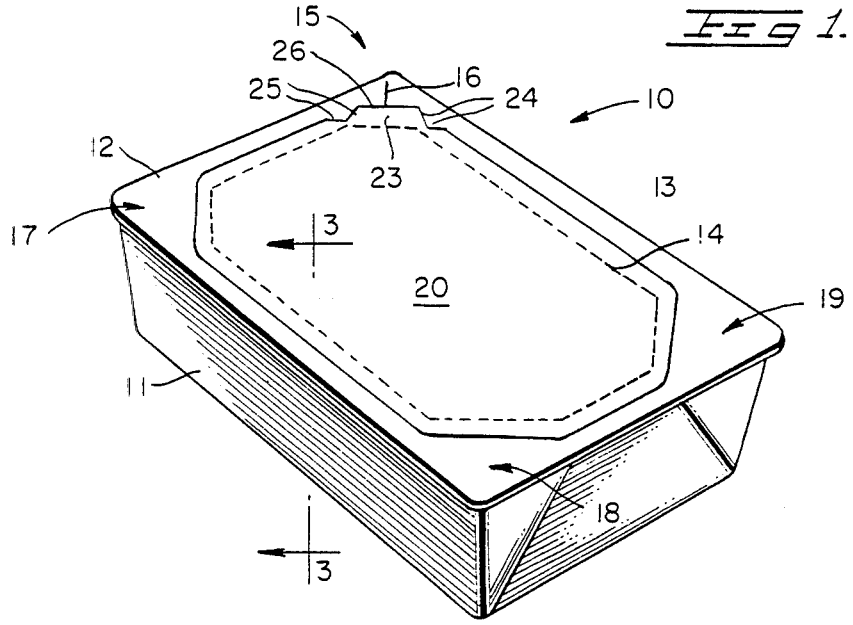
FIG. 1 is a perspective view of a tray type carton with a top cover member secured thereon which embodies the principal features of the present invention.

Referring to the drawings, and more particularly to FIG. 1, there is illustrated a tray type carton 10 which is adapted for ovenware use. The tray structure 11 is formed from a single sheet of flexible paperboard material which is coated with a heat resistant film and which preferably has leakproof corners as shown. Meanwhile the cover structure 12 is also formed from a single sheet of flexible paperboard material which is coated with a heat resistant film and which includes the novel removable lid portion 20 more fully disclosed hereinafter. It will be understood that the tray structure 11 preferably has flanges around the periphery of its outer walls and the cover structure 12 is sized to fully cover the flanges of the tray. Otherwise, the embodiments of the carton shown in the drawing are described and illustrated merely for setting forth the preferred forms of the invention. Thus the principles of the invention may be otherwise applied.

Figure 2:
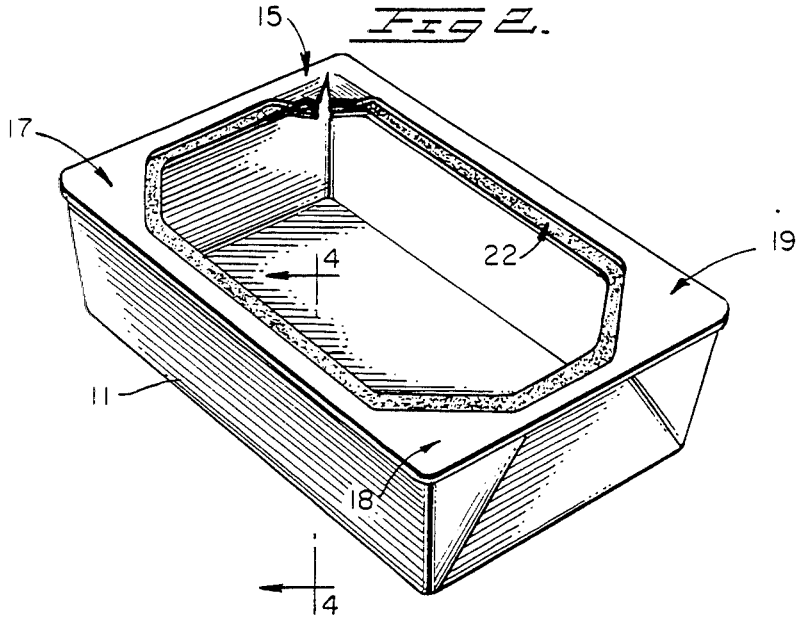
FIG. 2 is a perspective view of the carton of FIG. 1 with the lid portion removed.
Figure 3:
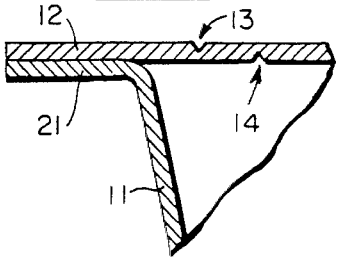
FIG. 3 is a fragemntary cross-sectional view taken on the lines 3—3 of FIG. 1 to an enlarged scale.
Figure 4:
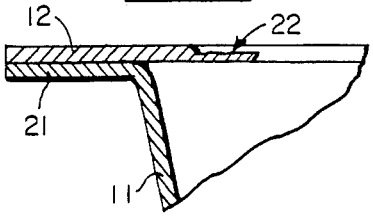
FIG. 4 is a fragmentary cross-sectional view taken on the lines 4—4 of FIG. 2 to an enlarged scale.

The cover structure 12 shown in FIGS. 1 and 2 is cut with its overall dimensions corresponding to the overall dimensions of the top of the tray 11, so that its margins may be adhesively secured on the top surface of the peripheral flange formation 21 on the tray. The panel member constituting the cover 12 includes a lid portion 20 and an easy opening means 16. The lid portion 20 is adapted for removal by a lift tab 23 which is integral with the lid portion. The lid portion 20 is formed in the cover 12 by a pair of cut lines 13, 14 which are located respectively, on the outer and inner surfaces of the cover 12. The cut lincs 13, 14 penetrate the opposite surfaces of the cover member to a point intermediate the thickness of the cover member. As shown in FIGS. 1 and 2, the cut lines 13, 14 are spaced from one another and are also spaced inwardly from the peripheral edge of the flange formation 21 of tray 11 particularly as shown in FIGS. 3 and 4. Further, the cut lines 13, 14 of FIGS. 1 and 2 are arranged to cut across the corners of the cover 12 to leave corner portions 15, 17, 18 and 19 of the cover 12 remaining on the tray 11 when the lid portion 20 is removed. This means that a substantial portion of the cover member 12 remains attached to the tray flange area 21 when the lid portion 20 is removed. The extra cover material provided at the sides and corners of the tray reinforces the tray in the flange area 21 and makes the tray 11 stronger than it otherwise would be without the extra material. Thus the tray and lid combination shown in FIGS. 1 and 2 is capable of carrying heavier and more unstable loads than trays which are not reinforced.

Since the cut lines 13, 14 are only partially cut into the opposite surfaces of the cover member 12 as shown in FIG. 3, the removal of the lid portion 20 produces a delaminated area 22 as shown in FIGS. 2 and 4. This is the preferred means for forming the cut out for lid portion 20. The opening means for the lid portion 20 is located in corner 15 of the cover member 12 and comprises the abbreviated and offset portions 24 and 25 of cut line 13 and the straight corner cut 26 of cut line 14 which together produce an opening tab 23. Access to the tab 23 is provided by a single cut line 16 that extends from the apex of corner 15 to a point which substantially bisects the diagonal portion 26 of cut line 13. As shown in FIG. 2, the tab 23 is released by pressing down on the corner 15 along cut line 16 so as to break the portion 26 of cut line 13. At this point, the tab 23 can be gripped and the lid portion 20 readily removed.

Figure 5:
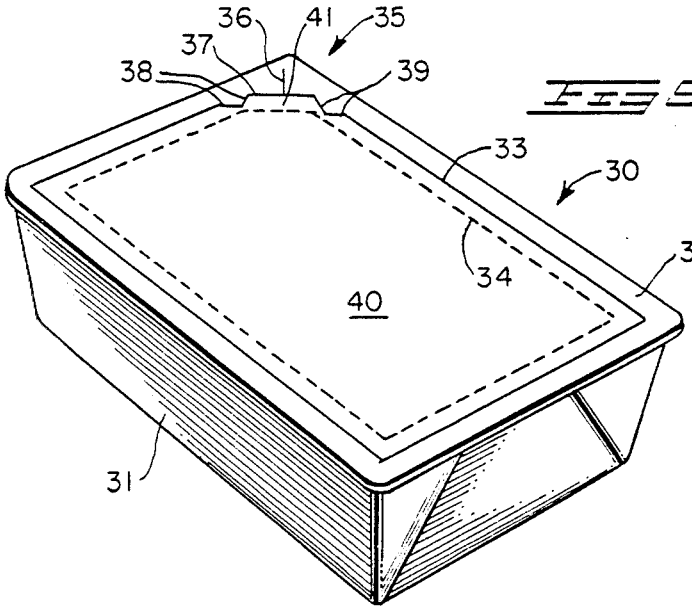
FIG. 5 is a perspective view of a second embodiment of a tray type carton according to the present invention.
Figure 6:
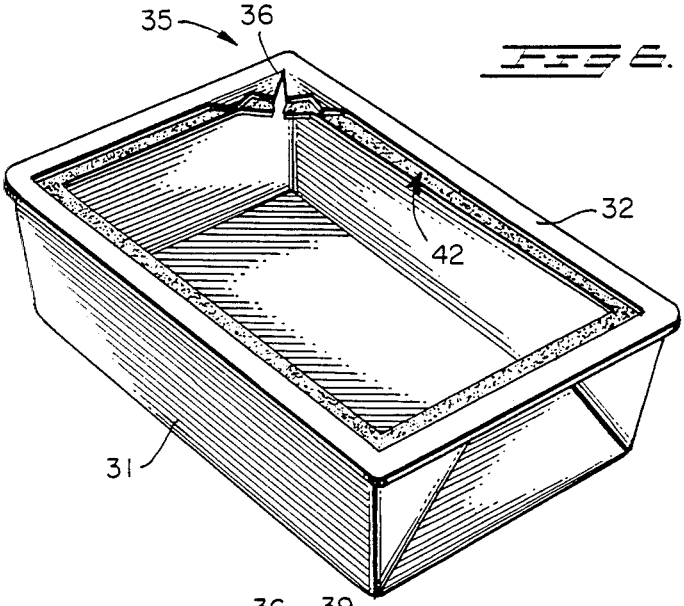
FIG. 6 is a perspective view of the carton of FIG. 5 with the lid portion removed.
Figure 7:
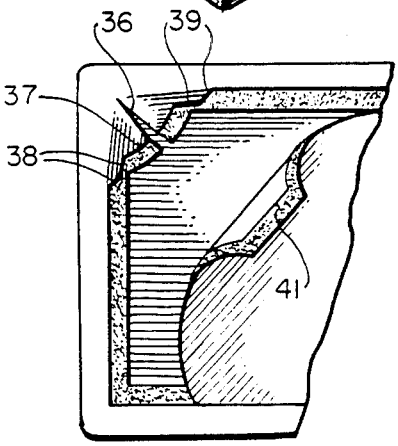
FIG. 7 is a partial top view of the carton of FIG. 5 showing the lid portion partially removed.

FIGS. 5–7 illustrate a second embodiment of the present invention wherein the carton 30 comprises a tray portion 31 and a cover portion 32. The general construction of the tray 31 and cover 32 is the same as that of the tray 11 and cover 12 shown in FIG. 1.

In the embodiment of FIGS. 5–7, the spaced apart partial cut lines 33, 34 in cover 32 are set inward from the flange area of the tray 31 on all four sides of the cover 32, but with only one corner portion 35. This construction provides a slightly larger lid portion 40 than the lid portion 20 in FIGS. 1 and 2, and still offers considerable reinforcement for the tray flange and tray 31 when the lid portion is removed as shown in FIG. 6. Meanwhile, the easy opening feature of the lid portion 40 is provided at corner 35 and consists of a straight cut line 36 extending from the apex of corner 35 to the straight portion 37 of cut line 33 which extends across corner 35. The remaining portions 38, 39 of cut line 33 at corner 35 together with cut line portion 37 form a lift tab 41 particularly as shown in FIG. 7. When the corner 35 is pushed downwardly in the region of cut line 36, the cut portions at 37, 38 and 39 are broken providing access to lift tab 41. Note in FIGS. 6 and 7 how the cut line 36 spreads open when pushed downwardly to remove the lid portion 40. In this manner, a positive start is made for removing the lid 40 yet the contents of the tray 31 remain undisturbed because of the presence of the delaminated area 42 in the corner 35 formed between the outer and inner partial cuts 33, 34 respectively. This arrangement enables the user to start the tearing along partial cut lines 33, 34 by lifting the tab 41 upwardly as shown in FIG. 7. The removal of lid portion 40 occurs essentially along the partial cut line 33 on the top face of cover panel 32. This leaves intact the part of the cover panel 32 glued to the flange area of the tray 31 plus an additional part of the cover member 32 all around the periphery of the carton 30. The added stiffness imparted to the tray 31 by the additional remaining part of cover member 32 is surprizingly large and enables the user of the tray to pick it up either at the corners or along one of the side walls without fear of the tray collapsing.

Figure 8:
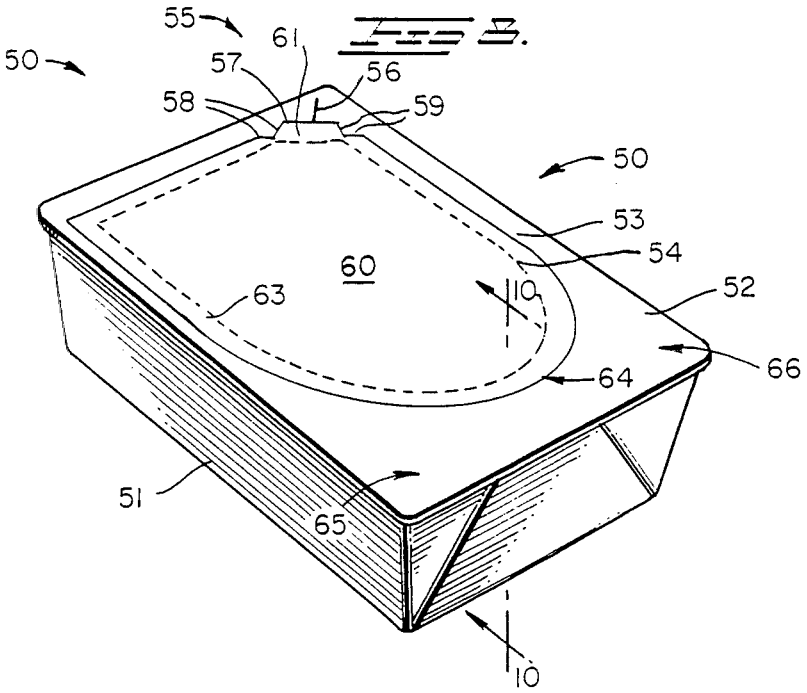
FIG. 8 is a perspective view of a third embodiment of a tray type carton according to the present invention.
Figure 9:
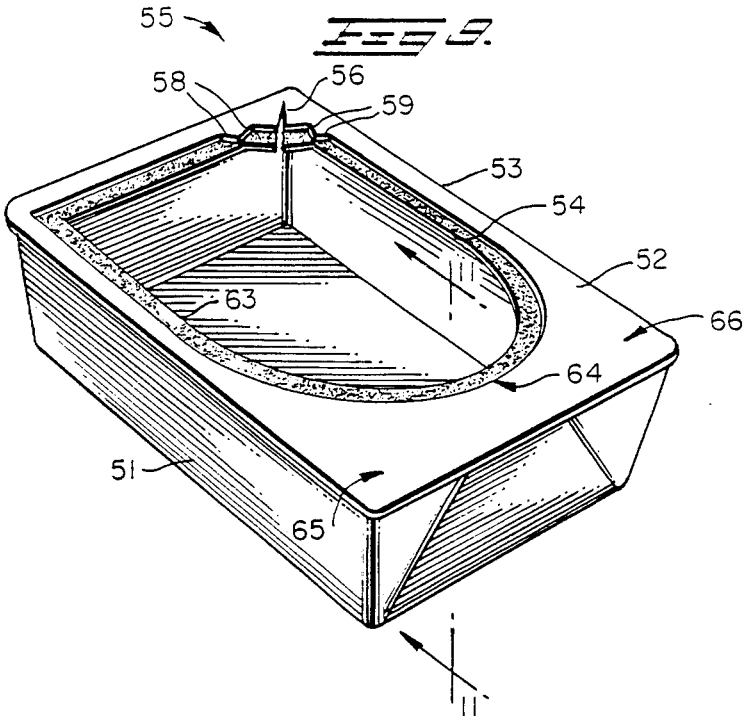
FIG. 9 is a perspective view of the carton of FIG. 8 with the lid portion removed.
Figure 10:
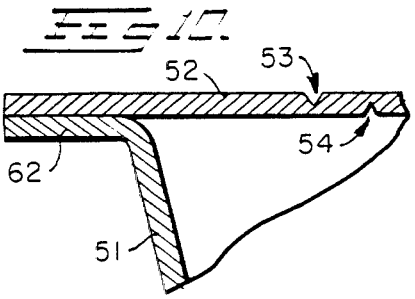
FIG. 10 is a fragmentary cross-sectional view taken on the lines 10—10 of FIG. 8 to an enlarged scale; and, FIG. 11 is a fragmentary cross-sectional view taken on the lines 11—11 of FIG. 9 to an enlarged scale.
Figure 11:
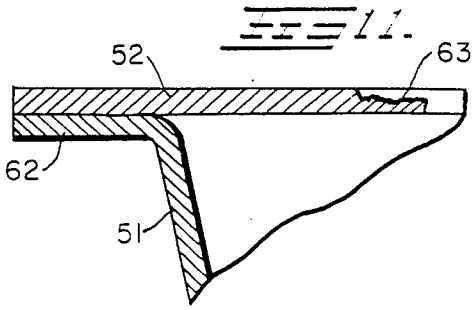

In FIGS. 8–11, a second modification is shown for the lid portion of the tray where maximum stiffness is required and limited access to the contents of the tray is permitted. In FIG. 8, a carton 50 is disclosed comprising a tray 51 and cover 52 with a removal lid portion 60 having a semicircular portion 64 at one end. The other construction features of the tray 51 and cover 52 are the same as described hereinbefore for FIGS. 1–7. For instance, the outer and inner partial cut lines 53, 54 respectively are spaced from one another and located inwardly from the flange area 62 of the tray 51 around all sides of cover member 52 with a corner 55 where the easy opening feature is provided. At corner 55, abbreviated parts 57, 58 and 59 of cut line 53 cooperate with the diagonal corner portion of cut line 54 to form a lift tab 61. Access to the lift tab 61 is provided by the cut line 56 which extends from the apex of corner 55 to cut line portion 57. Thus the user may start the tearing along partial cut lines 53, 54 by grasping the lift tab 61 and lifting. The removal of lid portion 60 exposes the delaminated area 63 which as shown in FIGS. 10 and 11 is offset from the flange area 62 of the cover member 52 by a considerable distance at one end of the tray. Thus removal of the lid portion 60 leaves large corner portions 65, 66 at one end of the tray as shown in FIG. 9 which dramatically improves the stiffness of the tray and increases its resistance to buckling or folding inadvertently when the carton is picked up from one end.

It will thus be seen that the present invention provides an improved lid structure which considerably increases the resistance of tray type structures to buckle and fold when handled. Accordingly, while several embodiments of the invention have been fully described and illustrated, these embodiments do not by any means limit the scope of the present invention, which should only be limited by the scope of the appended claims.

What is claimed is:

1. In combination, a cover member and a tray member both of substantially rectangular shape, said tray member having an outwardly extended integral top flange and said cover member having outer edges which are aligned with the outer edges of said tray flange, means for adhering the marginal edges of said cover member to the top flange area of the tray to close the tray, said cover member having at least four corners and comprising a generally planar blank of paperboard with upper and lower surfaces including a removable lid portion with an easy opening means, said removable lid portion being defined in said cover member by a pair of continuous, spaced apart, parallel cut lines of partial depth on the upper and lower surfaces of said cover member, said easy opening means comprising a first partial depth cut line in the upper surface of said cover member at one corner which extends from the apex of said corner to a diagonally oriented portion of said upper partial depth cut line between the adjacent sides of said corner, each end of the diagonally oriented portion of the upper cut line including abbreviated upper and lower partial depth cuts, portions of which are generally parallel to the diagonally oriented portion of the upper cut line and generally parallel to the upper partial depth cut lines along each adjacent side wall of the tray, said partial depth cut lines along all edges of the cover member being located inwardly from the innermost edge of the flange area of said tray throughout their entire lengths with the partial depth cut lines on the upper surface of said cover member being spaced from the innermost edge of the flange area by a distance equal to or greater than about one half the width of the flange area of said tray and the partial depth cut lines on the lower surface of said cover member being spaced from the innermost edge of the flange area by a distance equal to or greater than the total width of said flange area to define a delamination area therebetween, wherein upon removal of the lid portion, a substantial portion of the cover member remains adhered to the flange area of the tray around its entire periphery so that the structural rigidity of the tray is not reduced to any substantial degree when the lid portion is removed.

2. The combination of claim 1 wherein the partial depth cut lines in the upper and lower surfaces of said cover member are arranged at the remaining corners of said tray to extend diagonally across the cover member between adjacent sides of said tray to provide intact corner portions of said cover member adhered to the tray flange at each corner of said tray when the lid portion is removed for added structural strength.

3. The combination of claim 1 wherein the partial depth cut lines in the upper and lower surfaces of said cover member are arranged at the end of said tray opposite the easy opening means to extend in a generally arcuate pattern to provide intact corner portions of said cover member adhered to the tray flange at the end of said tray opposite the easy opening means when the lid portion is removed for added structural strength.

* * * * *